US006276618B1

(12) United States Patent
Yanagida et al.

(10) Patent No.: US 6,276,618 B1
(45) Date of Patent: Aug. 21, 2001

(54) ELECTROSTATIC POWDER SPRAY GUN

(75) Inventors: Kenzo Yanagida; Masahiro Yamamoto; Mitsuyoshi Kumata, all of Tokyo (JP)

(73) Assignee: Nihon Parkerizing Co., Ltd., Tokyo (JP)

( * ) Notice: Subject to any disclaimer, the term of this patent is extended or adjusted under 35 U.S.C. 154(b) by 0 days.

(21) Appl. No.: 09/073,984

(22) Filed: May 7, 1998

(30) Foreign Application Priority Data

May 14, 1997 (JP) ..... 9-124318

(51) Int. Cl.[7] ..... B05B 5/00

(52) U.S. Cl. ..... 239/693; 239/704; 239/706; 239/602; 239/DIG. 19

(58) Field of Search ..... 239/704, 706, 239/702, 705, 290, 291, 690, 693, 697

(56) References Cited

U.S. PATENT DOCUMENTS 3,940,061 * 2/1976 Gimple et al. ..... 239/291 X
4,238,077 * 12/1980 Hori ..... 239/707
4,921,172 * 5/1990 Belmain et al. ..... 239/706 X
5,725,670 * 3/1998 Wilson et al. ..... 239/706 X

* cited by examiner

*Primary Examiner*—Steven J. Ganey
(74) *Attorney, Agent, or Firm*—Wenderoth, Lind & Ponack, L.L.P.

(57) ABSTRACT

In an electrostatic powder spray gun, a cylindrical air curtain is formed toward the front side of a gun main body by supplying compressed air to an air chamber formed between the outer peripheral surface of a cover member and an outer cylinder so as to eject the air from an air blowing opening. Owing to the air curtain, powder particles move toward an object to be coated without the risk of scattering to an ion trap electrode.

7 Claims, 1 Drawing Sheet

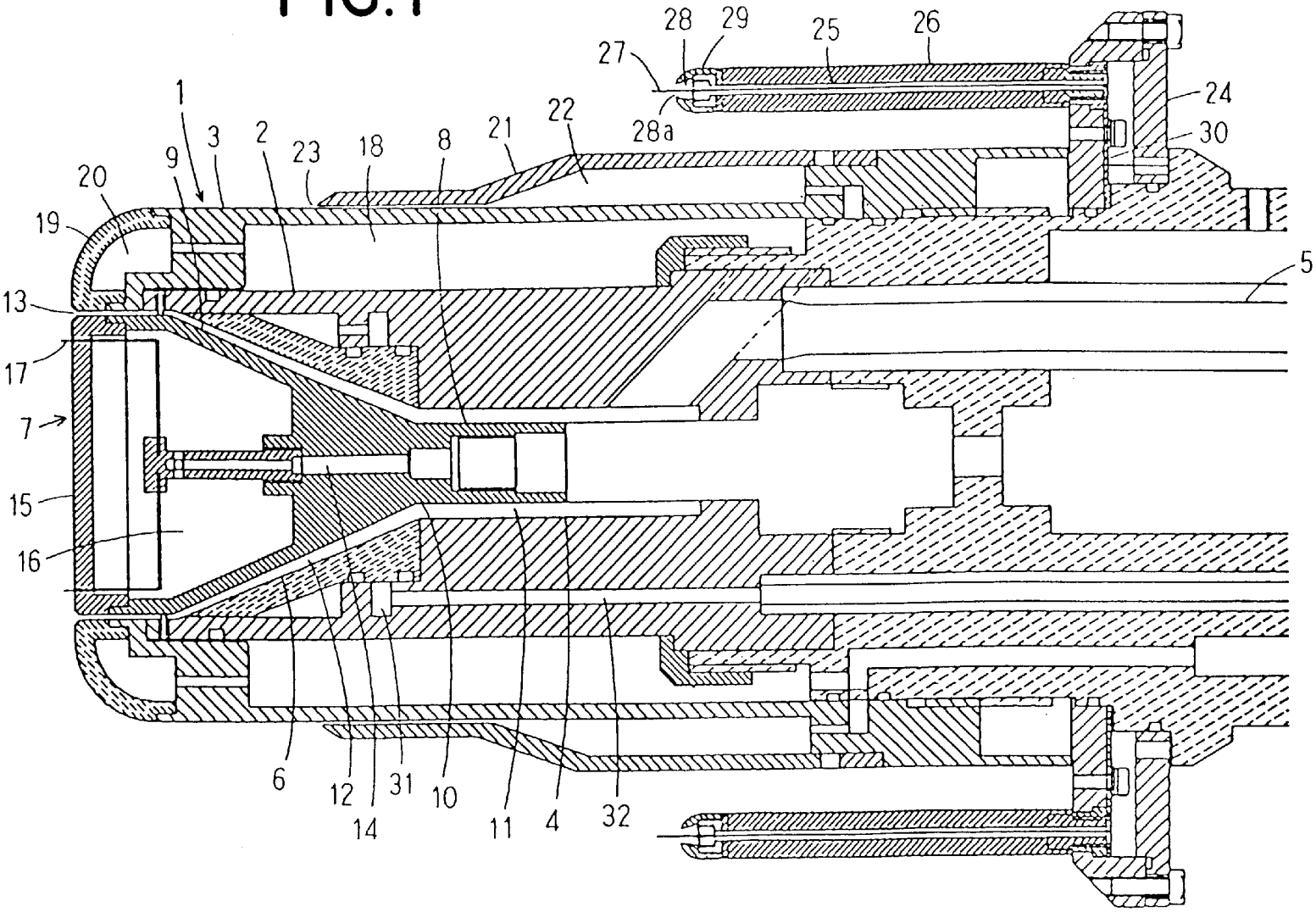
FIG. I

ELECTROSTATIC POWDER SPRAY GUN

BACKGROUND OF THE INVENTION

1. Field of the Invention

The present invention relates to an electrostatic powder spray gun for applying a charge to powder particles and blowing the same onto an object to be coated, utilizing electrostatic electricity.

2. Description of the Related Art

From the viewpoint of environmental conservation, an electrostatic powder spray gun attracts attention as an environment-friendly, non-polluting coating method without the need of using a solvent. In electrostatic powder coating, powder particles are supplied from a powder hopper to a spray gun via an injector so that the powder particles are sprayed with a conveying air flow to an object to be coated from a nozzle opening formed at the tip portion of the spray gun. At such time, the object to be coated is grounded, and a high voltage is applied to a pin type charging electrode(s) provided at the tip portion of the spray gun so that a corona discharge is generated from the charging electrode to the object to be coated. Therefore, the powder particles discharged from the nozzle opening collide with ions generated by the corona discharge so as to be charged during passage of the discharged particles in the vicinity of the electrode. The powder particles accordingly charged are coated on the surface of the object to be coated by the conveying air flow and along lines of electric force.

However, it is known that, in general, in powder coating, charged powder particles discharged from the tip of the spray gun can partially adhere to the periphery of the spray gun without contributing to coating film formation. If the powder particles continue to partially adhere to the spray gun, the adhered powder particles gradually aggregate on the periphery of the spray gun to generate the risk of a so-called spit, where the aggregated particles are flipped onto the object to be coated and adheres to the coated surface. Besides, since part of the powder particles do not contribute to film formation, a problem is involved in that the transfer efficiency of the powder particles is deteriorated.

Further, with a smaller size powder particle, the powder particle is lighter, so that the ratio of particle adherence to the periphery of the spray gun increases and the transfer efficiency further deteriorates.

Moreover, by providing an electrically-grounded ion trap electrode(s) rearwardly with respect to the charging electrode of the spray gun, for trapping free ions generated by the corona discharge, since an electric field is formed between the charging electrode and the ion trap electrode, part of the powder particles are drawn to the rear side of the spray gun by the electrostatic attracting force from the electric field so as to be easily adhered to the outer peripheral portion of the spray gun.

SUMMARY OF THE INVENTION

In order to solve the above-mentioned problems, an object of the present invention is to provide an electrostatic powder spray gun capable of preventing spit generation by restraining the adherence of the powder particles to the spray gun and improving the transfer efficiency to the object to be coated.

An electrostatic powder spray gun according to the present invention for electrostatically coating charged powder particles onto the surface of an electrically-grounded object to be coated comprises a gun main body for spraying forwardly powder particles and charging the powder particles, and an air curtain forming device for forming an air curtain by ejecting air forwardly of the gun main body along the outer surface of the gun main body for preventing the powder particles from scattering.

As an air curtain forming device, an outer cylinder covering the gun main body may be provided such that an air chamber is formed around the outer surface of the gun main body, a ring like air blowing opening being formed between the outer surface of the gun main body and the front end portion of the outer cylinder. Furthermore, a free ion trap device may be provided for trapping free ions.

BRIEF DESCRIPTION OF THE DRAWINGS

FIG. 1 is a cross-sectional view showing the configuration of an electrostatic powder spray gun according to an embodiment of the present invention.

DESCRIPTION OF THE PREFERRED EMBODIMENT

Hereinafter an embodiment of the present invention will be described with reference to the accompanied drawing.

FIG. 1 shows a configuration of an electrostatic powder spray gun according to an embodiment of the present invention. A cylindrical gun main body 1 comprises an inner cylinder 2, and a cover member 3 for covering the outer peripheral portion of the inner cylinder 2. A tube-like opening portion 4 is formed concentrically with the center axis of the inner cylinder 2 and communicates with a powder path 5. A conical opening portion 6 is formed forwardly of the opening portion 4, communicating with the opening portion 4 and gradually expanding forwardly.

A diffuser 7 is inserted in the opening portions 4 and 6 of the inner cylinder 2. The diffuser 7 has a diffuser main body 10 comprising a column portion 8 and a conical portion 9, communicating with the column portion 8 and gradually expanding forwardly. The column portion 8 of the diffuser main body 10 has a diameter slightly smaller than the diameter of the opening portion 4 of the inner cylinder 2 so that a cylindrical channel 11 communicating with the powder path 5 is formed between the outer peripheral surface of the column portion 8 and the opening portion 4 of the inner cylinder 2. On the other hand, the conical portion 9 of the diffuser main body 10 is formed slightly smaller than the conical opening portion 6 of the inner cylinder 2, so that a conical channel 12 communicating with the channel 11 is formed between the outer peripheral surface of the conical portion 9 and the opening portion 6 of the inner cylinder 2, and a ring-like nozzle opening 13 communicating with the channel 12 is formed with respect to the tip portion of the cover member 3. Further, a compressed air path 14 which opens in the front end surface of the conical portion 9 is formed along the center axis of the diffuser main body 10.

The diffuser 7 further comprises a diffuser front cover 15 made of a porous material attached at the front end portion of the diffuser main body 10. An air chamber 16 communicating with the compressed air path 14 is formed between diffuser front cover 15 and the front end surface of the diffuser main body 10 inside the nozzle opening 13.

A pin type corona electrode 17 is provided inside the nozzle opening 13 at the front end portion of the diffuser main body 10 such that the tip portion of the corona electrode 17 penetrates through the diffuser front cover 15 so as to project to the front side of the diffuser 7. The corona electrode 17 is electrically connected with a high voltage generator (not illustrated) in the gun main body 1 through the compressed air path 14 of the diffuser main body 10.

A cylindrical air chamber 18 is formed between the cover member 3 and the outer peripheral surface of the inner cylinder 2. A ring-like cover 19 made of a porous material is provided at the tip portion of the cover member 3 outside of the nozzle opening 13. Within the ring-like cover 19 is an air chamber 20 communicating with the air chamber 18.

A cylindrical outer cylinder 21 is provided at the outer peripheral portion of the cover member 3 such that an air chamber 22 is provided between the outer peripheral surface of the cover member 3 and the outer cylinder 21. A front portion of the outer cylinder 21 is reduced to a diameter slightly larger than the outer diameter of the cover member 3, such that a ring-like air blowing opening 23 is formed by a gap of about 0.1 mm width between the front end portion of the outer cylinder 21 and the outer peripheral surface of the cover member 3.

Ring members 24 are provided at the outer periphery of the gun main body 1. Each ring member 24 projects forwardly of the gun and is attached to a rod-like ion trap supporting member 26 with a compressed air path 25 formed on the center axis thereof An ion trap tip cover 29 is provided at the tip portion of each ion trap supporting member 26 such that an air chamber 28 for ion trap cleaning, communicating with the compressed air path 25, is formed at the base portion of an ion trap electrode 27, and a nozzle hole 28*a* is formed for ejecting compressed air in the air chamber 28 toward the tip portion of the ion trap electrode 27. The ion trap electrodes 27 are electrically connected by a ring-like conductive member 30 with each other and are electrically connected with a ground terminal (not illustrated) provided at the rear part of the gun main body 1. The free ion trap device includes the ion trap electrodes 27 and the conductive member 30.

A ring-like vortex air chamber 31 is provided in the inner cylinder 2, surrounding the conical channel 12. The vortex air chamber 31 and the channel 12 communicate with each other by a plurality of vortex air introduction openings (not illustrated) formed in the direction of the tangent of the channel 12. The vortex air chamber 31 communicates with a vortex air path 32 formed in the inner cylinder 2.

The diffuser front cover 15 and the ring-like cover 19 are made of a porous material such as temporarily-sintered polyethylene, teflon, or another porous resin, and the like for allowing the passage of the compressed air. The other members including the inner cylinder 2, the cover member 3, the diffuser main body 10, the outer cylinder 21, the ion trap supporting member 26, and the like are formed by a resin such as teflon and high density polyethylene so as to tend to prevent the adherence of powder particles.

The operation of the electrostatic powder spray gun according to the above embodiment will be explained. A power source is connected to a high voltage generator (not illustrated) so as to generate a high voltage. The high voltage is applied to the corona electrode 17 so as to generate a corona discharge from the corona electrode 17 toward an object to be coated (not illustrated). Since the grounded ion trap electrodes 27 are provided rearwardly of the corona electrode 17, lines of electric force concentrate at the ion trap electrodes 27. Most of free ions generated in the vicinity of the corona electrode 17 move along the lines of electric force so as to be trapped by the ion trap electrodes 27.

In such state, powder particles are supplied from the powder path 5 to the cylindrical channel 11 by conveyance air, and compressed air is supplied from the vortex air path 32 to the vortex air chamber 31. When the powder particles reach the conical channel 12 from the cylindrical channel 11, since the air supplied to the vortex air chamber 31 is ejected in the direction of the tangent of the channel 12 via the vortex air introduction openings (not illustrated), the conveyance air flows around the central axis of the channel 12 so that the powder particles are sprayed from the channel 12 through the ring-like nozzle opening 13 while moving in a vortex. The powder particles are charged by the ions generated by the corona discharge and are sprayed to the object to be coated (not illustrated) so as to obtain a homogeneous coat film.

At such time, a part of the powder particles after being charged by the ions generated by the corona discharge, tend to move to the ion trap electrodes 27 along the lines of electric force with most of free ions. Therefore, air is sprayed from the air blowing opening 23 by supplying compressed air to the air chamber 22 formed between the outer peripheral surface of the cover member 3 and the outer cylinder 21. Since the air blowing opening 23 is formed with a ring-like shape along the outer peripheral surface of the cover member 3, the air sprayed from the air blowing opening 23 forms a cylindrical air curtain toward the front side of the gun main body 1. Owing to such air curtain, the powder particles can move to the object to be coated (not illustrated) without scattering in the directions of the ion trap electrodes 27. Accordingly, adherence of the powder particles to the outer peripheral surface of the cover member 3 or the outer cylinder 21 can be prevented.

However, with such air curtain, a part of the powder particles sprayed from the nozzle opening 13 can easily be adhered to the vicinity of the diffuser front cover 15 and the ring-like cover 19. Therefore, compressed air is supplied from the compressed air path 14 to the air chamber 16, and compressed air is supplied to the inside of the air chamber 18 so that the compressed air passes through the diffuser front cover 15 and the ring-like cover 19, made of porous material, and is ejected forward by, thus blowing the powder particles away and preventing adherence.

Further, if the powder particles flow in the vicinity of the gun main body 1 in such a powder coating so as to be adhered in the vicinity of the ion trap electrodes 27, compressed air is supplied to the compressed air path 25 of each of the ion trap supporting members 26. The compressed air passes through each compressed air path 25 and enters the air chamber 28 for ion trap cleaning and is ejected from the nozzle hole 28*a* to the tip portion of the ion trap electrode 27, by this discharge of compressed air, the powder particles can be blown away.

According to the electrostatic spray gun of the present invention, since an air curtain is formed by ejecting air forwardly along the outer side of the gun main body, scattering of powder particles can be restrained to prevent adherence to the gun main body, and transfer efficiency can be improved. The present invention is particularly effective for a fine particle powder, since a powder particle with a small size is lightweight and is easily scattered. Moreover, since the powder particles cannot be attracted to the free ion trap device by the electrostatic attracting force from the electric field formed between the charging electrode and the free ion trap device, by adapting the present invention to a spray gun comprising a free ion trap device for trapping free ions, a particularly remarkable effect can be achieved in terms of the prevention of the adherence of the powder to the gun main body and improvement of transfer efficiency.

Powder particles may be sprayed without applying a high voltage to the charging electrode at the time of test spraying for setting coating conditions, but the powder particles can easily be charged by friction with the wall surface of the conveyance path while passing through the conveyance path to be discharged from the nozzle opening of the spray gun. Therefore, the charged powder particles can easily adhere to the vicinity of the spray gun. However, according to an electrostatic powder spray gun of the present invention, since the air curtain is formed along the outer side portion of the gun main body, adherence of the powder particles to the spray gun can be prevented at the time of test spraying.

What is claimed is:

1. An electrostatic powder spray gun for electrostatically coating charged powder particles onto a surface of an electrically-grounded object to be coated, said spray gun comprising:

a gun main body from which powder particles are sprayed and for charging the powder particles;

an air curtain forming device for forming an air curtain by ejecting air along an outer surface of said gun main body in a direction toward a front side thereof, thereby to prevent the powder particles from scattering; and a free ion trap device for trapping free ions, said free ion trap device including a ring member at an outer peripheral portion of said gun main body, a plurality of ion trap supporting members projecting from said ring member toward said front side of said gun main body, and a plurality of electrically-grounded pin-shaped ion trap electrodes fixed to respective said supporting members;

wherein said gun main body includes an inner cylinder having therethrough a powder flow path, a cylindrical cover member covering an outer peripheral portion of said inner cylinder, a conically-shaped diffuser at a front side of said powder flow path, and a ring-shaped nozzle opening at an outer peripheral portion of said diffuser; and wherein said diffuser includes a front cover composed of porous material and forming a front end surface of said diffuser, and a first air chamber at a rear side of said front cover, compressed air supplied to said first air chamber being ejected through said front cover to a front side thereof.

2. A spray gun as claimed in claim 1, wherein said air curtain forming device includes an outer cylinder covering said gun main body and defining an air chamber around an outer surface thereof, and a ring-shaped blowing opening between said outer surface of said gun main body and a front end portion of said outer cylinder.

3. A spray gun as claimed in claim 1, further comprising a plurality of pin-shaped electrodes at a front end portion of said diffuser.

4. A spray gun as claimed in claim 1, further comprising a ring-shaped cover at a front of said cylindrical cover member, said ring-shaped cover being composed of porous material, and a cylindrical second air chamber between said cylindrical cover member and said outer peripheral portion of said inner cylinder, compressed air supplied to said second air chamber being ejected through said ring-shaped cover to said front side of said gun main body.

5. A spray gun as claimed in claim 1, further comrising a vortex flow forming structure for forming a vortex air flow with conveying air supplied to said powder flow path of said inner cylinder.

6. A spray gun as claimed in claim 1, wherein each said ion trap supporting member has therethrough a respective air flow path, compressed air being ejected through each said air flow path from a periphery of the respective said electrode.

7. A spray gun as claimed in claim 1, wherein each said electrode extends from a tip of a respective said supporting member.

* * * * *